US009561942B2

(12) United States Patent
Busuttil et al.

(10) Patent No.: US 9,561,942 B2
(45) Date of Patent: Feb. 7, 2017

(54) CAM DRIVEN WEDGE BRAKING SYSTEM FOR MULTI-STAGE LIFTS

(75) Inventors: John Joseph Busuttil, Kirkland, WA (US); Steven Citron, Oceanside, CA (US); Mark Mattson, Carlsbad, CA (US)

(73) Assignee: LIFTSMART, LLC, Oceanside, CA (US)

( * ) Notice: Subject to any disclaimer, the term of this patent is extended or adjusted under 35 U.S.C. 154(b) by 575 days.

(21) Appl. No.: 13/416,803

(22) Filed: Mar. 9, 2012

(65) Prior Publication Data

US 2012/0228064 A1 Sep. 13, 2012

Related U.S. Application Data

(60) Provisional application No. 61/452,050, filed on Mar. 11, 2011.

(51) Int. Cl.

| | |
|---|---|
| ***B66F 9/07*** | (2006.01) |
| ***B66F 9/08*** | (2006.01) |
| ***B66F 9/075*** | (2006.01) |
| ***B66F 17/00*** | (2006.01) |

(52) U.S. Cl.

CPC ..... *B66F 9/07559* (2013.01); *B66F 9/087* (2013.01); *B66F 17/003* (2013.01)

(58) Field of Classification Search

CPC ..... B66F 9/07559; B66F 9/087; B66F 17/003
USPC ..... 187/226, 62.5, 223
See application file for complete search history.

(56) References Cited

U.S. PATENT DOCUMENTS

| | | | | |
|---|---|---|---|---|
| 3,247,930 A * | 4/1966 | Lagerman | 187/223 |
| 4,015,686 A * | 4/1977 | Bushnell, Jr. | 182/148 |
| 4,031,980 A * | 6/1977 | Terayama et al. | 182/103 |
| 5,141,081 A * | 8/1992 | Kregel et al. | 187/235 |
| 5,515,945 A | 5/1996 | Smith et al. | |
| 5,645,142 A | 7/1997 | Kraemer et al. | |

FOREIGN PATENT DOCUMENTS

| | | | |
|---|---|---|---|
| DE | 198 59 935 A1 | 10/1999 | |
| EP | 443843 A1 * | 8/1991 | B66F 9/08 |

OTHER PUBLICATIONS

International Search Report and Written Opinion mailed Oct. 19, 2012 in PCT/US2012/028574 filed Mar. 9, 2012.
European Patent Application No. 12757585.0, Supplementary European Search Report, mailed Nov. 7, 2014.

* cited by examiner

*Primary Examiner* — Michael Mansen
*Assistant Examiner* — Diem Tran
(74) *Attorney, Agent, or Firm* — Kilpatrick Townsend & Stockton LLP

(57) ABSTRACT

Apparatus for braking relative vertical movement between two vertical members includes linkage connected either directly or indirectly to a cable pulley-mount that is spring loaded and moves cams that wedge in between two vertically moveable members when cable tension is not present at the pulley. A broken cable, for example, will create a situation where there is no cable tension between a plurality of cable pulleys, the lack of cable tension moves the mechanical cam style linkage to engage the braking members.

20 Claims, 13 Drawing Sheets

CAM DRIVEN WEDGE BRAKING SYSTEM FOR MULTI-STAGE LIFTS

CROSS-REFERENCE TO RELATED APPLICATION

The present application claims the benefit of provisional application No. 61/452,050, filed on Mar. 11, 2011, the full disclosure of which is incorporated herein by reference.

TECHNICAL FIELD

The present invention relates to a braking system for stopping relative movement between the stages of a multi-stage lift in case of failure of the lifting mechanism such as, for example, failure of a cable when the lifting mechanism is a reeving system.

BACKGROUND

Several systems have been developed and patented over the years as part of an ongoing effort to continuously improve the safety of various lifting machinery. Embodiments herein contemplate a significant improvement over prior art both in the prevention of inadvertent nuisance tripping and the overall performance of the braking system of a multi-stage lift when actuated.

U.S. Pat. No. 4,015,686 discloses a multi-stage lift which was in commercial production for many years. In this lift, the stages include like extruded aluminum mast sections which interfit in front to back relation and are separated in the front to back direction by guide rollers. The lift stages are elevated by operation of a reeving system including a cable between a rear winch and a front carriage which passes over top and bottom pulleys in each extensible stage, a top pulley on the back stationary stage, and a pulley on the carriage. The carriage pulley and the bottom pulleys on the extensible stages are spring-biased to move downwardly in case of cable failure. Such downward movement swings a locking pawl into operating position into an adjacent recess provided by a locking channel on the adjoining stage, thus stopping further movement of the mast sections upon cable failure.

The device described in U.S. Pat. No. 4,015,686 did not consistently function as intended and was prone to failure because the locking pawl would not engage into the adjacent recess provided by the locking channel on the adjoining mast stage due to acceleration, or manufacturing alignment tolerances between the pawl and the channel, or if it did engage it would rip through the slotted channel only slowing down the inevitable collapse of the multi-stage lift system. The device, when deployed in a real life cable break situation (and when it would actually function as intended), would frequently damage the multi-stage mast assembly, which is not ideal but was generally acceptable if life, limb, or property damage was averted. In many cases a full engagement of the system would leave the multi-stage mast assembly so damaged that it would be completely unusable and unrepairable (scrap).

U.S. Pat. No. 5,645,142 discloses a multi-stage lift which has also been in commercial production for many years. In this lift, the stages comprise like extruded aluminum mast sections which interfit in front to back relation and are separated in the front to back direction by guide rollers. The lift stages are elevated by operation of a reeving system including a cable between a rear winch and a front carriage which passes over top and bottom pulleys in each extensible stage, a top pulley on the back stationary stage, and a pulley on the carriage. The braking system of this device operates by the wedging of knurled rollers between a sloped face on a first mast section and a vertical face on an adjacent mast section. The sloped face is provided by a ramp member on the first mast section. A flange projects from a bottom of the ramp toward the vertical face of the adjacent mast section. A slide rod freely extends through a vertical opening in this flange. A pair of the knurled rollers are mounted adjacent an upper end of the rod at opposite sides of the rod. The slide rod extends through a compression spring seated on the flange. Normally, this spring is engaged at the top by a stop pin on the slide rod and is compressed by the combined weight of the rod and rollers. However, if the mast stage on which the ramp member is mounted accelerates downwardly relative to the adjacent mast stage, the compression spring responsively expands and causes the wedging rollers to move up the ramp so that they are wedged between the ramp member of the first mast section and the vertical face of the adjacent mast section. In this wedging position, the knurled rollers stop further downward movement of the ramp member and associated first mast section relative to the adjacent mast stage.

The device described in U.S. Pat. No. 5,645,142 functions fairly consistently but, since it is triggered by gravity versus lack of cable tension, it is prone to inadvertent nuisance tripping. That is, the braking system sometimes engaged even when a cable failure was not present. As examples, such inadvertent trippings may occur simply by the operator lowering the multi-stage mast assembly in an accelerated fashion or, in such a similar manner, when turning the crank on the winch with uneven gyrations or oscillations which result in a situation that momentarily simulates a quick downward acceleration strong enough and for a duration long enough to simulate the free fall of a vertical mast member. These actions result in the compression spring responsively expanding and causing the wedging knurled rollers to occupy a wedging position, stopping further downward movement of the ramp member and associated mast section relative to the adjacent mast stage. The situation is compounded by the fact that these multi-stage lifts are frequently transported in pick-up trucks and other vehicles in the horizontal position, allowing the wedging rollers to move to a wedging position during transport of the lift. When the lift is placed back in the vertical position it is possible that some of the knurled rollers do not fall back into their normal operating position. The inadvertent nuisance tripping of this device causes significant customer dissatisfaction and it is not uncommon that a multi-stage lift gets stuck in the elevated position and must be carefully laid down on it back by forklifts or other devices so that a service mechanic can use a special tool to disengage the wedge roller(s) from the wedge position(s). This is an expensive situation as it involves a service call to a qualified mechanic and the act of taking a multi-stage lift that is in a vertical position 25 ft. in the air and laying it on its back in the horizontal position can be dangerous and may be very difficult to accomplish if the lift is in a tight location.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein provide a significantly improved multi-stage lift braking system, compared to the prior art previously mentioned, that will consistently function without inadvertent and unnecessary actuation and that will provide improved overall performance.

Embodiments include a multi-stage lift substantially similar to the two described in the previously mentioned patents. In this lift, like the others, the stages comprise like extruded aluminum mast sections which interfit in front to back relation and are separated in the front to back direction by guide rollers. The lift stages are elevated by operation of a reeving system including a cable between a rear winch and a front carriage. The cable passes over top and bottom pulleys in each extensible stage, a top pulley on the back stationary stage, and a pulley on the carriage. The carriage pulley and the bottom pulleys on the extensible stages are spring-biased to move a mechanical linkage that turns multiple knurled heads between vertically moving members of the multi-stage lift creating a spring-loaded camming device effect, wedging and ultimately braking the vertical movement between multiple mast sections. Embodiments herein solve a large number of problems with the devices previously mentioned and commercialized as described below:

Embodiments here provide for a significant improvement in the performance of a braking system for a multi-stage lift assembly by providing a positive engagement method, through turning the knurled cam heads into a wedging position between multiple vertical members that move adjacent to each other, thereby stopping or substantially slowing down the movement and collapse of a multi-stage lift assembly. Embodiments herein avoid the gravity actuated nuisance tripping commonly occurring in existing braking systems today, because it actuates off cable tension versus gravity to engage and disengage the system.

In accordance with additional embodiments, a method is provided to disengage the braking system (when it has not aggressively engaged) by merely creating cable tension which, in turn, rotates the knurled locking cams out of the engagement position (unlike the existing art that requires specialized tools to disengage the braking system once engaged). Embodiments herein provide the best elements of both devices previously described and avoids the inherent problems of each respective system as well. The embodiments herein were not readily apparent to personnel trained and skilled in the art as the patent described in U.S. Pat. No. 5,645,142 commercially replaced the device described in U.S. Pat. No. 4,015,686 but brought on an additional set of performance issues. The braking system disclosed in U.S. Pat. No. 5,645,142 has been commercialized for nearly 20 years and no one skilled in the art has thought of any new alternatives since then—until now.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1A:
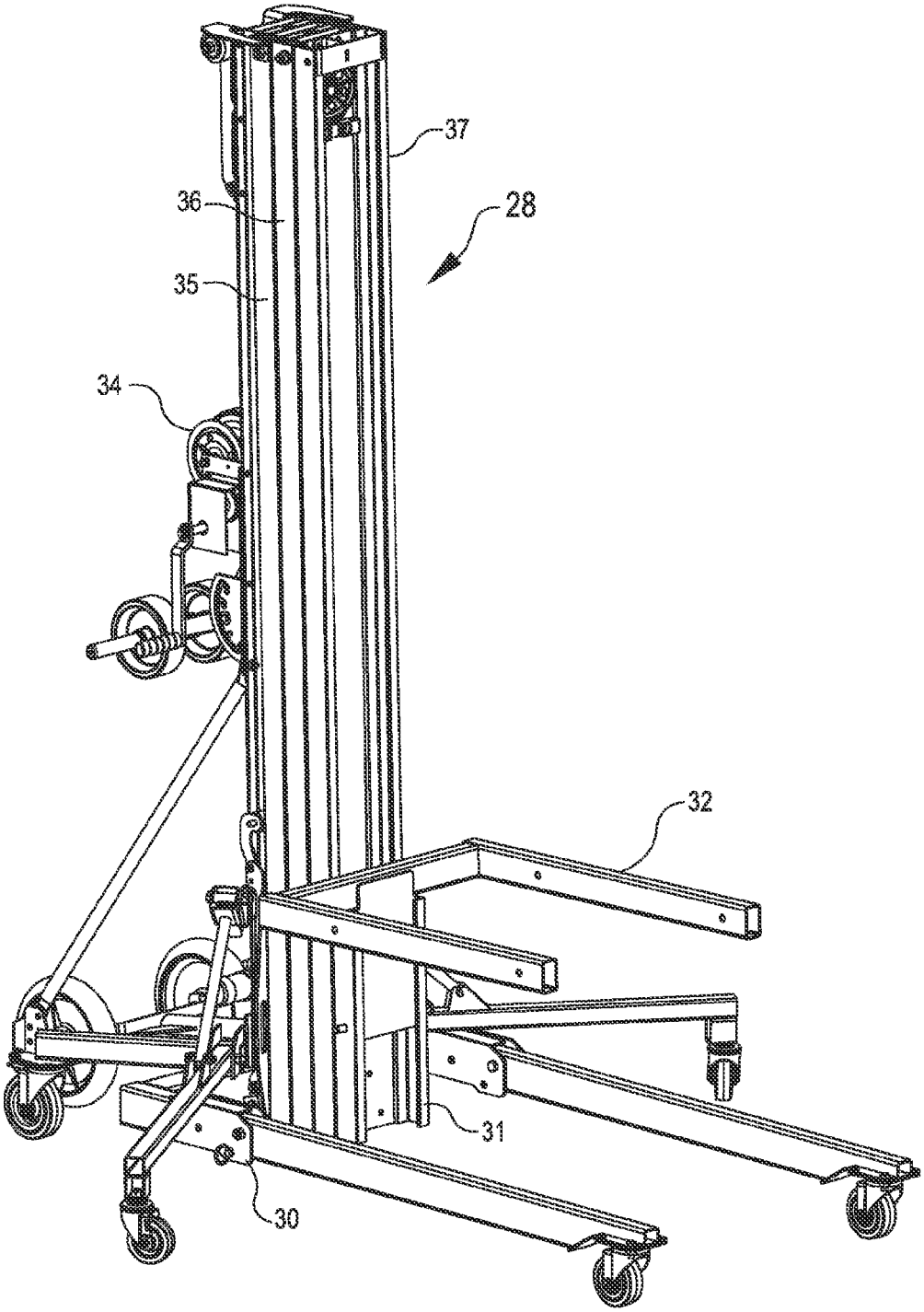
FIGS. 1A & 1B are perspective views of a portable lift to which embodiments have been applied.

As shown in FIG. 1A, the braking system of in accordance with embodiments is shown operating in an improved portable multi-stage lift 28 to be now described having a mobile base assembly 30.

Figure 1B:
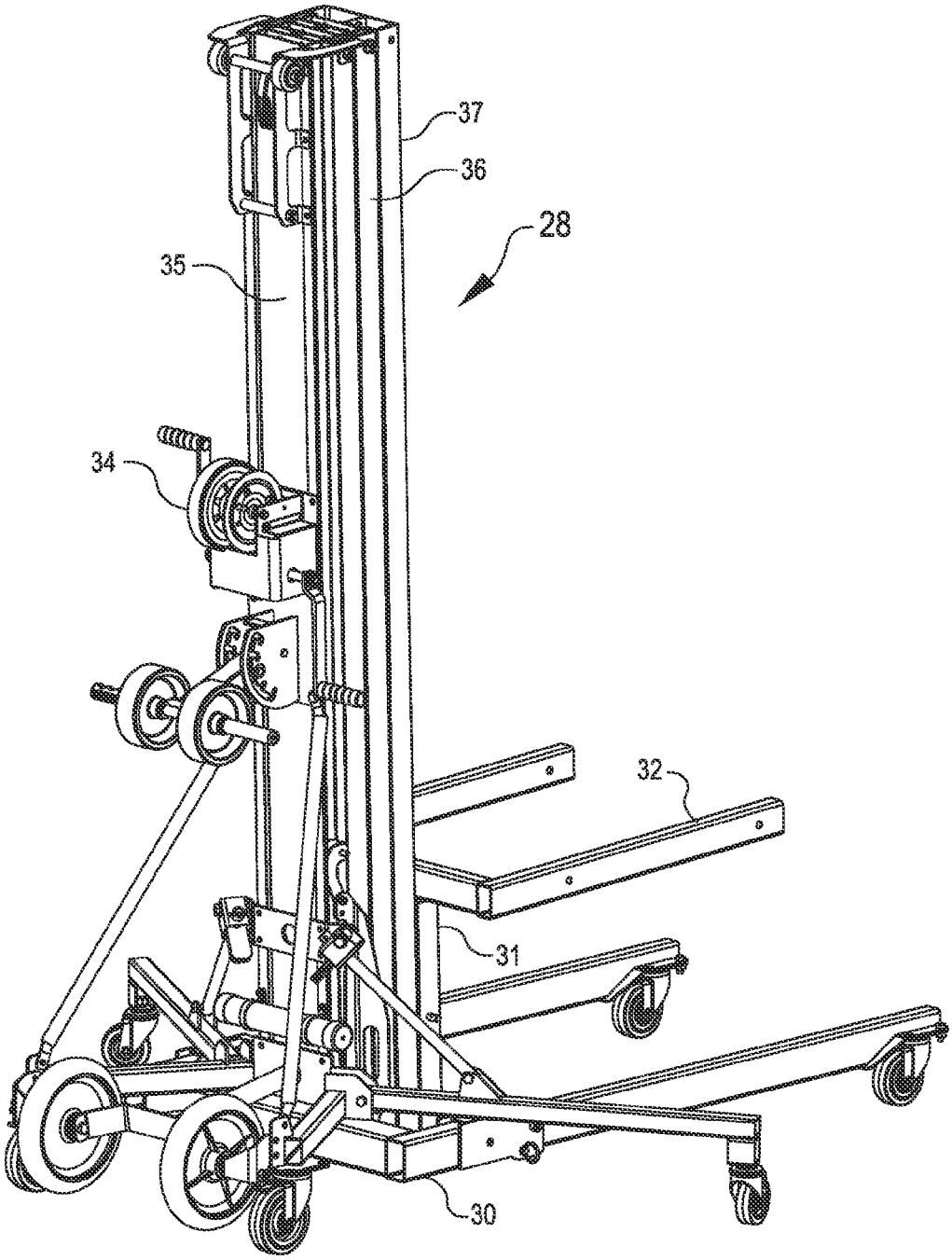

The lift 28 has a front carriage section 31 which can carry a load support 32. At the rear (FIG. 1B) the lift 28 has a winch 34 which may be manually operated or can be a motor driven unit. The winch 34 is mounted on the rear of a back stationary mast stage 35. For purposes of example, two extensible mast stages 36, 37 have been illustrated between the back stage 35 and the carriage 31, but one or more than two could be provided.

Figure 2:
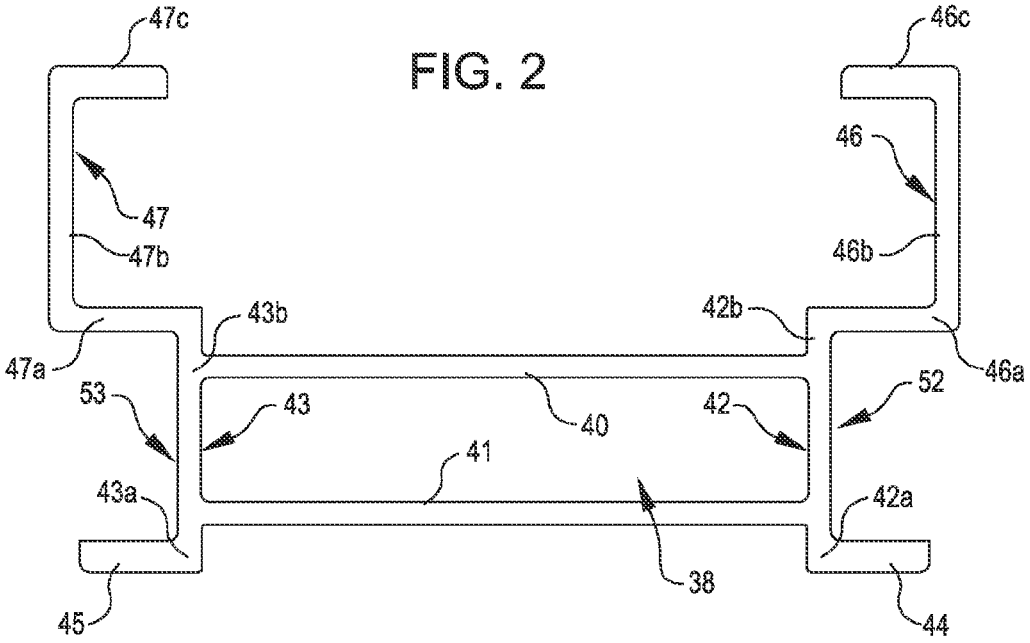
FIG. 2 is an end view of an extruded aluminum section for a mast of the lift of FIGS. 1A and 1B made in accordance with embodiments.

The mast stages 35, 36, 37 and carriage 31 are preferably identical in cross-section and comprise a length of extruded aluminum bar stock whose cross-section is shown in FIG. 2. It will be seen that each mast stage has a central hollow column 38 of generally rectangular cross-section having front and back walls 40, 41 and a pair of right and left side walls 42, 43 extending there between. At the rear of the column 38 the side walls 42, 43 continue rearwardly at 42*a*, 43*a* and join back laterally extending flanges 44, 45. At the front of the column the side walls 42, 43 continue forwardly at 42*b*, 43*b* and join right and left inturned front channels 46, 47 comprising outwardly extending central flanges 46*a*, 47*a*, outside sections 46*b*, 47*b*, and inturned front flanges 46*c*, 47*c*. It will be noted that the central flanges 46*a*, 47*a* together with the walls 42, 43 and back flanges 44, 45 define right and left outwardly facing back channels 52, 53.

Figure 6:
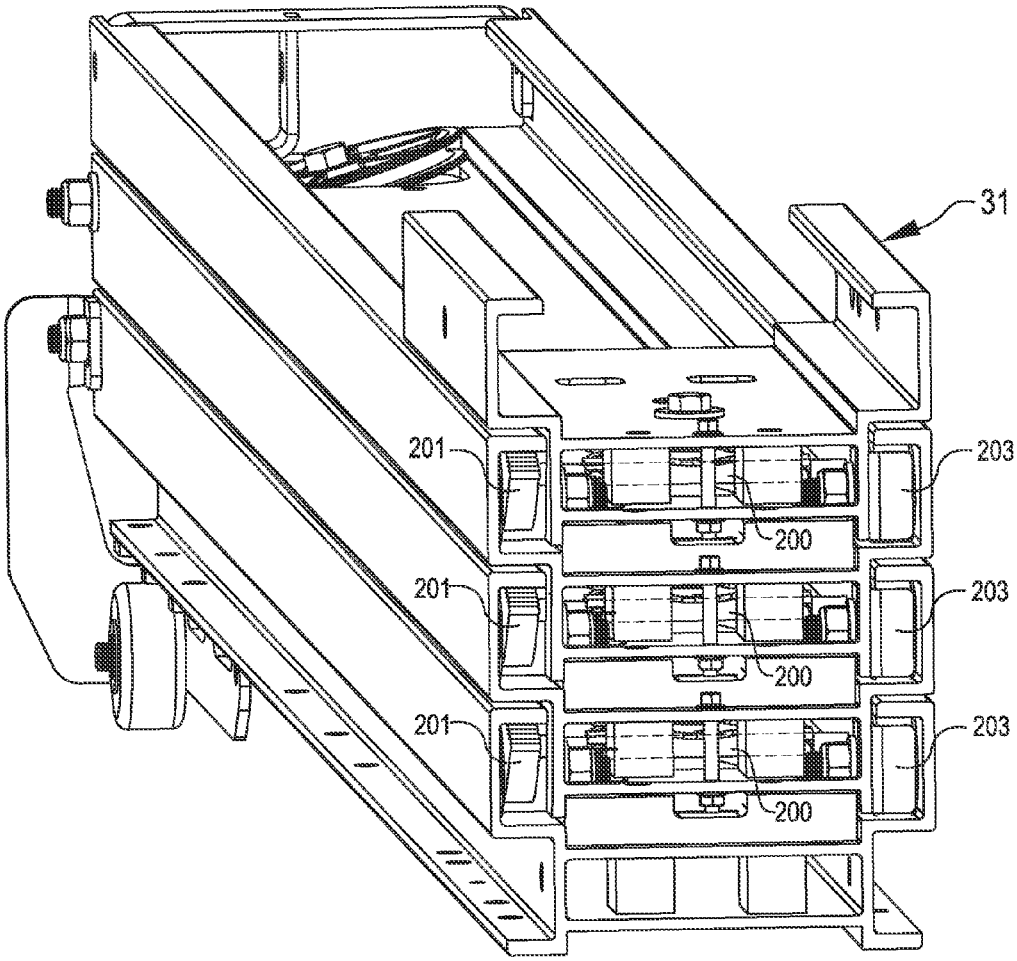
FIG. 6 is an end view of the bottom of the mast assembly for the portable lift of FIGS. 1A and 1B, with the roller wheels and covers depicted on the right side and the roller wheels and covers removed on the left side to show cam brakes.
Figure 7:
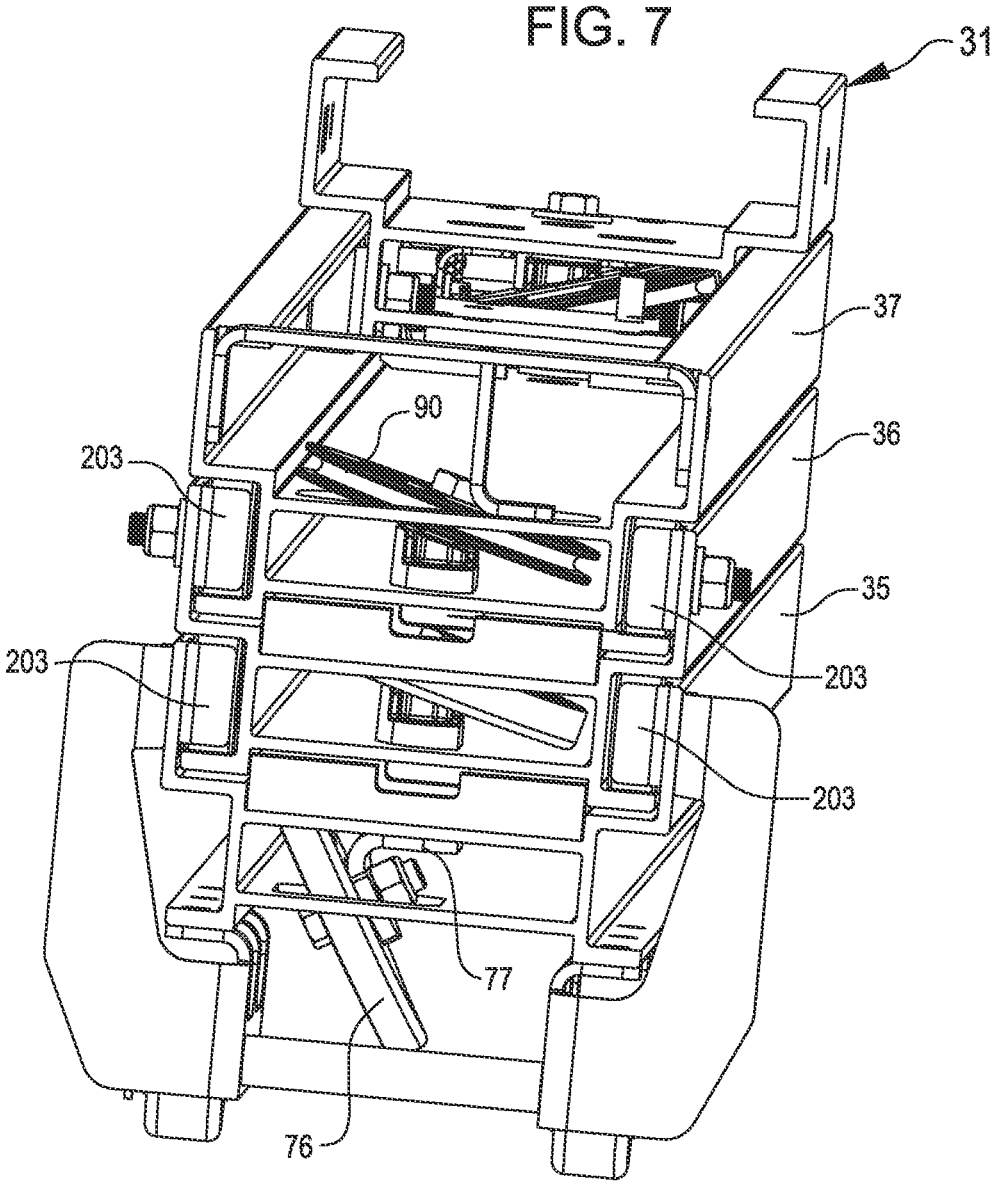
FIG. 7 is an end view of the top of the mast assembly for reference.

Directing attention to FIG. 6, the described mast stage configuration enables the front inturned channels 46, 47 of one mast stage to interfit with the back out-turned channels 52, 53 of a second mast stage with the back flanges 44, 45 of the front stage facing the front of the central flanges 46*a*, 47*a* of the back stage, and the front flanges 46*c*, 47*c* of the back stage facing the rear of the central flanges 46*a*, 47*a* of the front stage. When mast stages 35, 37 are interfitted as described, a plurality of side-to-side glide blocks 350 located at the top and bottom of each column track on the right and left side of each adjacent mast stage preventing excess slop and maintaining vertical alignment of each mast stage.

Figure 4:
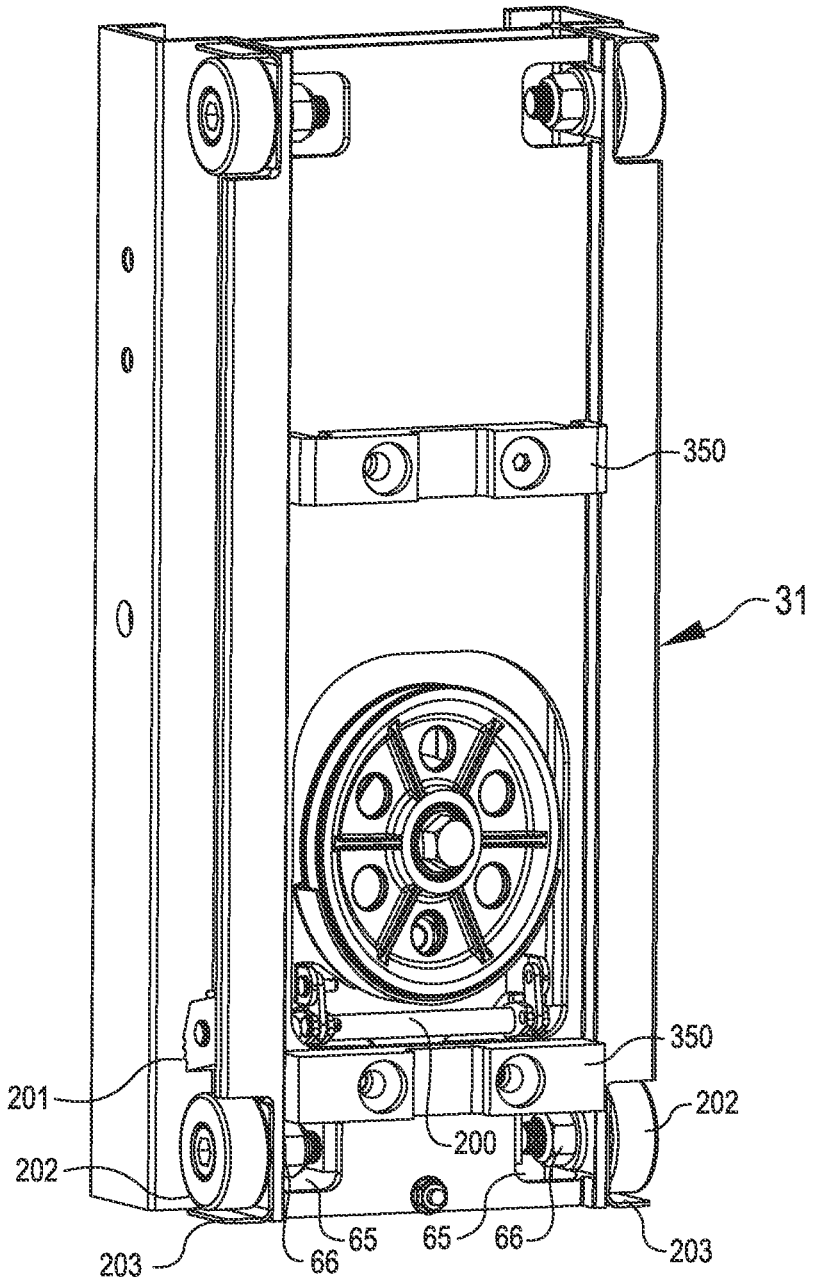
FIGS. 4 & 5 are close-up views of a carriage for the portable lift of FIGS. 1A and 1B depicting a linkage connected to knurled cams and a pulley-mount (behind a pulley)
Figure 5:
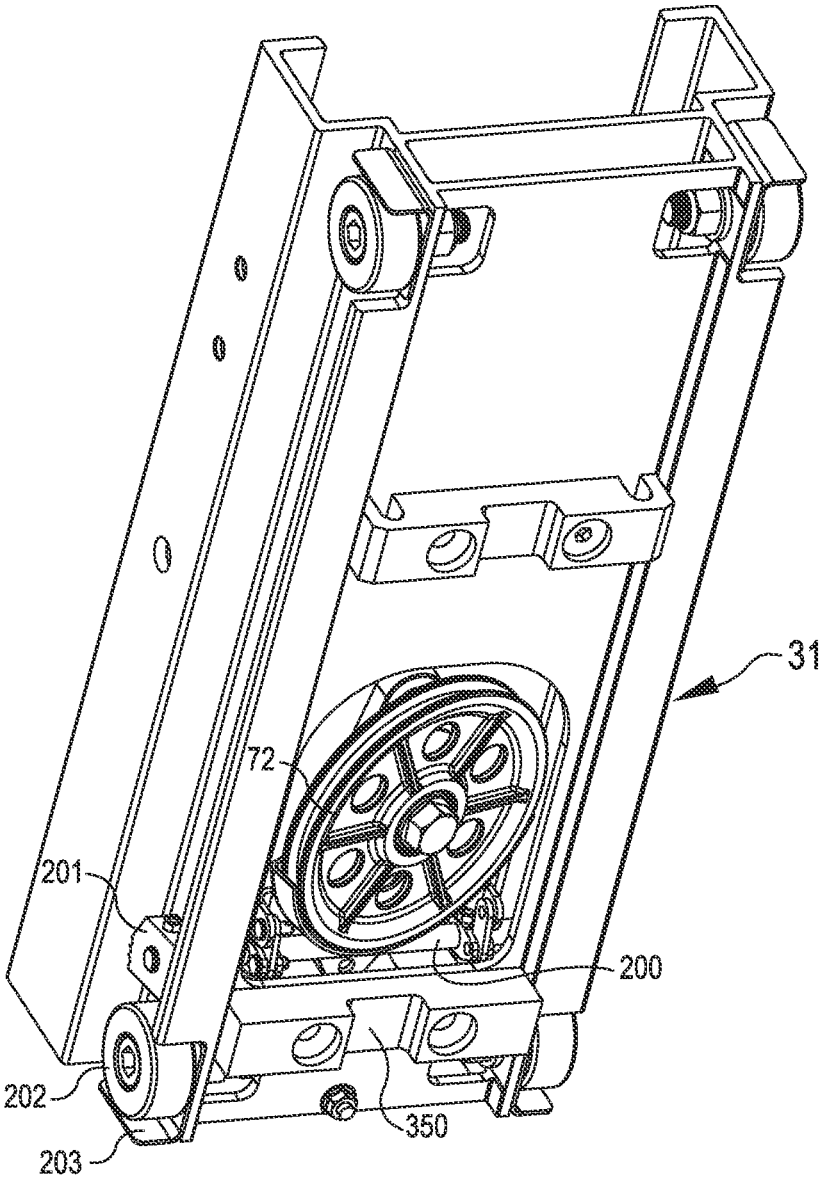
Figure 10:
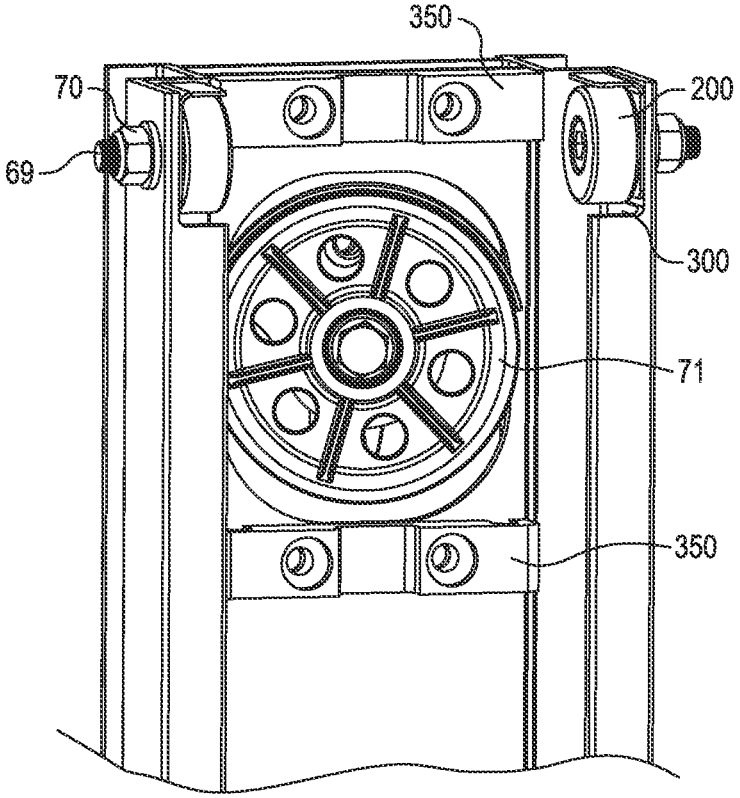
FIG. 10 depicts the uppermost portion of a mast stage illustrating the locations for a pulley, glide blocks, and cutouts for upper roller wheels, as well as other components.

Front to back alignment of the mast stages is provided by bottom front-to-back pairs of rollers 202 (e.g., FIG. 5) on mast stages 35, 36 and 37, and top front-to-back pairs of rollers 203 on stages 35-36. Cutouts are provided at the bottom of the back flanges 44, 45 of the mast stages, and a central bottom cutout 65 (FIG. 4) is provided in the back wall 41 of the mast stages. These cutouts 65 provide operating space for the rear portion of the bottom rollers 202 and access to washers and nuts 66 on the bolt shafts for these rollers passing through the right and left walls 42, 43. Space for the front portion of the top rollers 203 is provided by top cutouts 300 (FIG. 10) in the front flanges 46*c*, 47*c*. The shaft bolts 69 for the top rollers 203 pass outwardly through the outside sections 46*b*, 47*b* to receive washers and nuts 70. With the described arrangement of front-to-back rollers, the bottom rollers 202 track on the rear face of the front inturned flanges 46*c*, 47*c* or the front face of the intermediate flanges 46*a*, 47*a* of the rear mast stage of interfitting mast stages. Similarly, the top front-to-back rollers 203 track on the front face of the rear out-turned flanges 44, 45 or the back face of the intermediate flanges 46*a*, 47*a* of the front stage of interfitting mast stages. The carriage 31 has front-to-back rollers 202 adjacent its four corners.

Many features of the mast system in the current embodiment are known in the prior art. For example, the reeving systems described in the background section of this disclosure are known, and a similar system is used in the current lift. However, to aid the reader, FIG. 3 shows a prior art mast system, many similar parts of which are used in the present lift.

Figure 3:
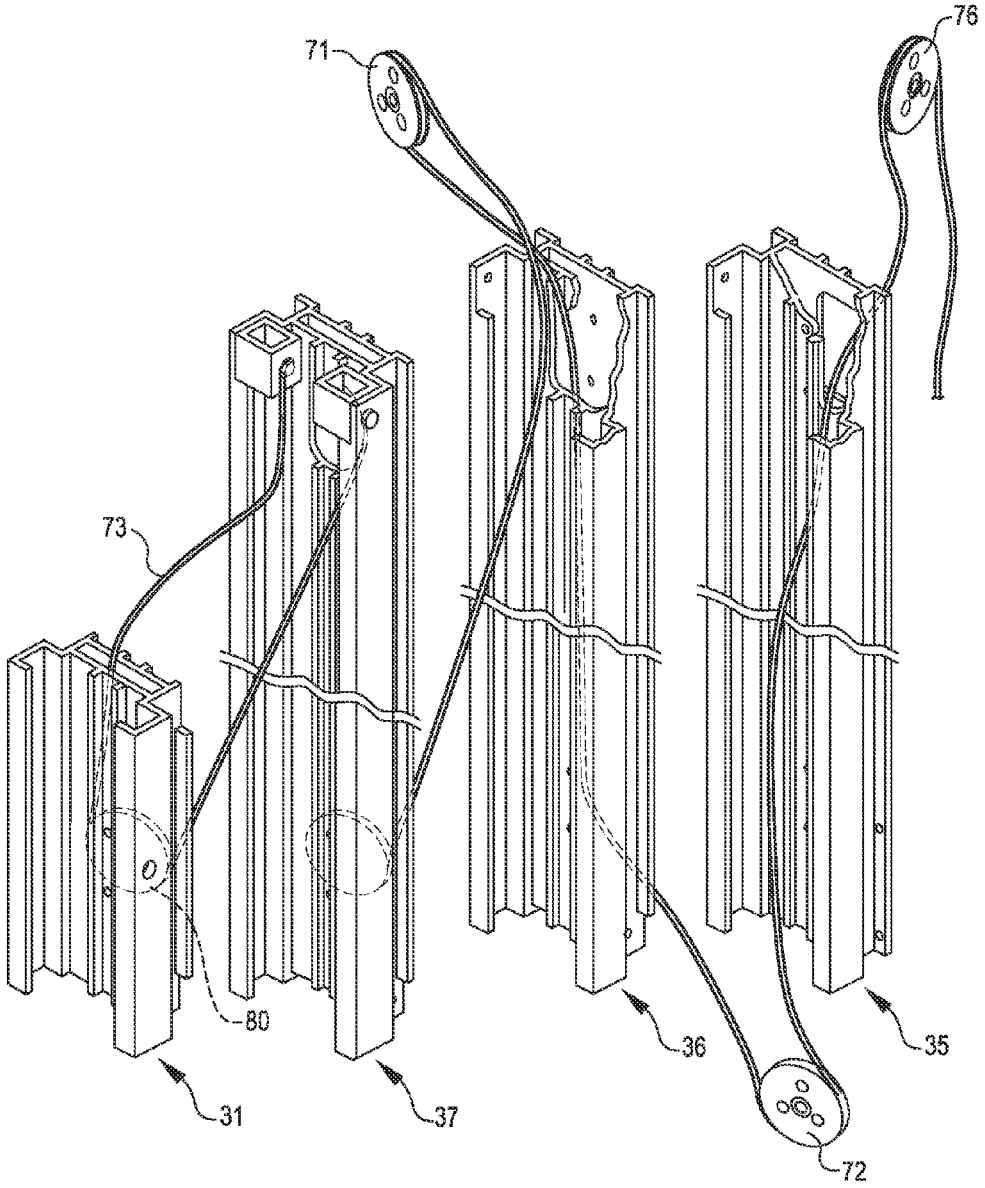
FIG. 3 is an exploded view illustrating a reeving arrangement for a carriage and mast stages of a prior art lift.

Referring to FIG. 3, each of the extensible mast stages 36-37 has a top pulley 71 and a bottom pulley 72 adjacent its ends for receiving a cable 73, from the winch 34. Each top pulley 71 extends through a cutout 74 in the front wall 40 of the respective mast stage, and each bottom pulley 72 extends through a cutout 75 in the back wall 41 of the respective mast stage. The rear stationary mast stage 35 has a single upper pulley 76 journal-mounted on an angle bracket 77 mounted on its front wall and extending through registering cutouts 78 in the front and back walls thereof. The carriage 31 has a pulley 80 extending through a cutout in its back wall.

The two upper pulleys 71 are tilted such as to extend rearward into the right portion of a center passage of the respective mast stage. The two lower pulleys 72 and the carriage pulley 80, on the other hand, angle rearward from the right portion of the central passage 85 to the left passage 55 which is next to the rear. This positions the pulleys such that the cable 73 extends from the upper end of the front mast stage 37, and is reeved on the pulleys by traveling under the carriage pulley 80, then over the top pulley 71 and under the bottom pulley 72 of the extensible mast stages 37, 36 progressing from front to back, then travelling over the top pulley 76 on the back stationary mast stage 35 and down to the winch 34.

Figure 12:
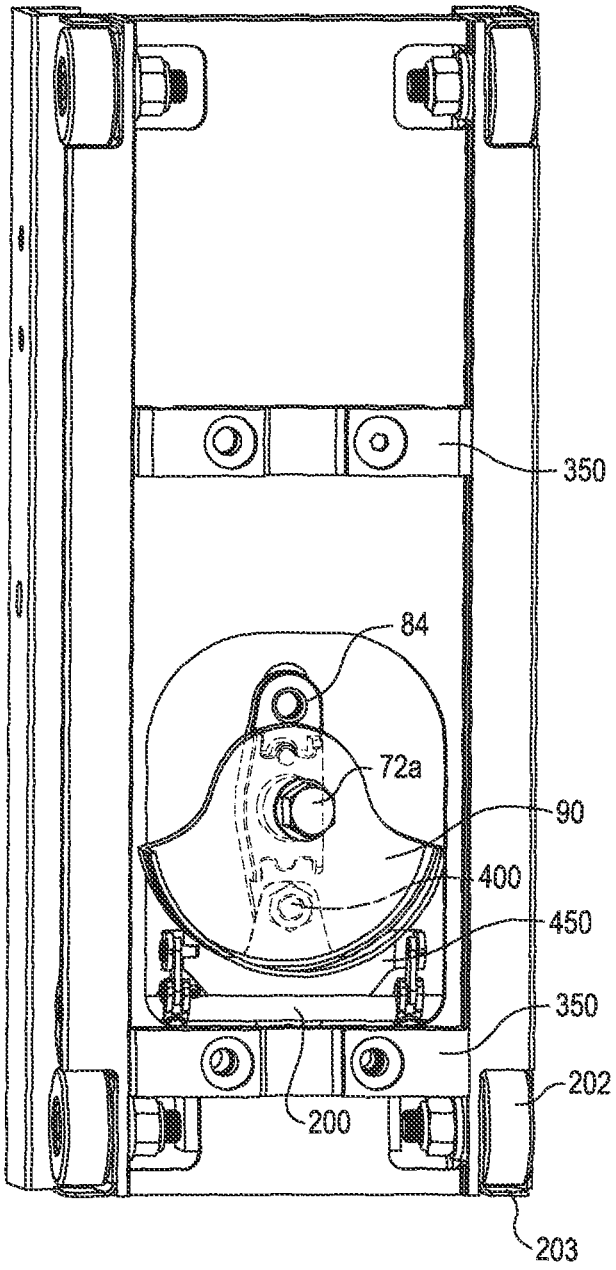
FIG. 12 depicts the same view as FIG. 11, but adds the cable pulley cover for reference.
Figure 14:
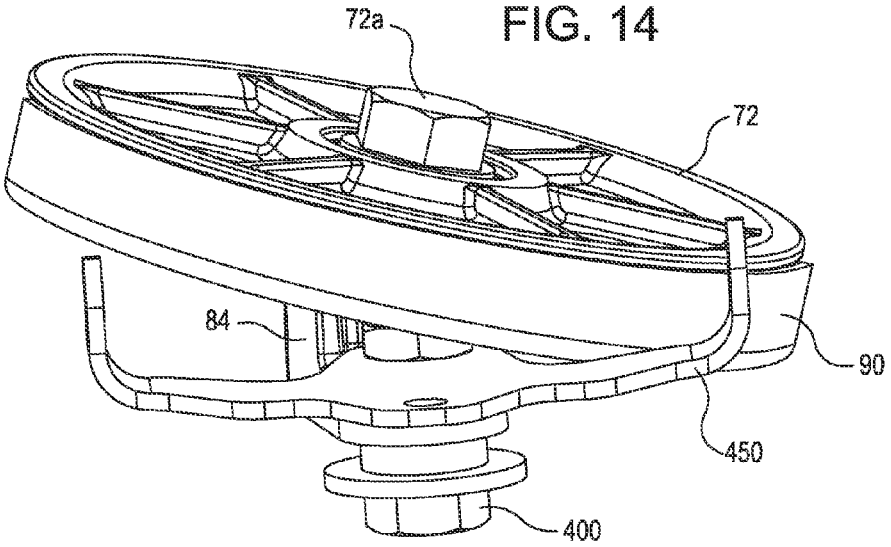
FIG. 14 is a perspective view of the cable pulley, pulley guard, pulley mounting block and connected linkage.

In embodiments, the pulleys 71, 72, 76 and 80 are provided with guards 90 (FIGS. 12 and 14). One of these guards 90 is discussed more below.

From the foregoing description it is seen that the carriage 31 and the extensible mast sections 36-37 are roller guided front-to-back and glide block guided for side-to-side motion for smooth up and down travel. When cable is taken up on the winch 34, first the carriage 31 travels up the mast stage 37. Then the front extensible stage 37 is raised following which the next stage 36 is raised. It will be apparent that additional extensible mast sections can be added which duplicate stage 36.

Figure 8:
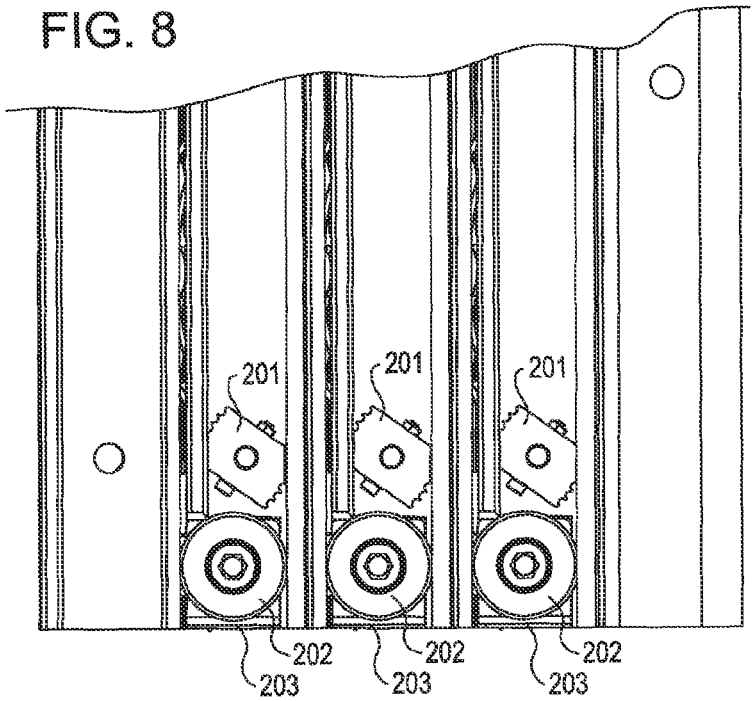
FIG. 8 is a partial cutaway, side view of the mast assembly depicting knurled cams of a braking system for the mast, with the cams in a non-engaged position.

The braking system in accordance with embodiments is adapted to stop downward travel of the carriage 31 and extensible mast stages 36, 37 in case of a lift failure such, for example, as a failure of the cable 73. As further described below, the braking system includes a spring loaded lower cable pulley mount 84 (FIGS. 12 and 14) that moves mechanical linkages 450 and 200 and knurled toothed cams 201 from engaged (FIG. 9) to disengaged (FIG. 8) braking positions depending on cable tension at the lower pulleys. In embodiments, the cams may be formed of any material that is capable of high friction (to stop movement of the adjacent mast sections) and that is hard enough to "bite" into the mast column (e.g., not just wear away or bend as a result of engagement). As an example, if the mast sections are formed of aluminum, then the cams may be formed of an aluminum alloy that is harder than the aluminum mast sections, but a brass, plated steel or stainless steel cam could also work.

Figure 11:
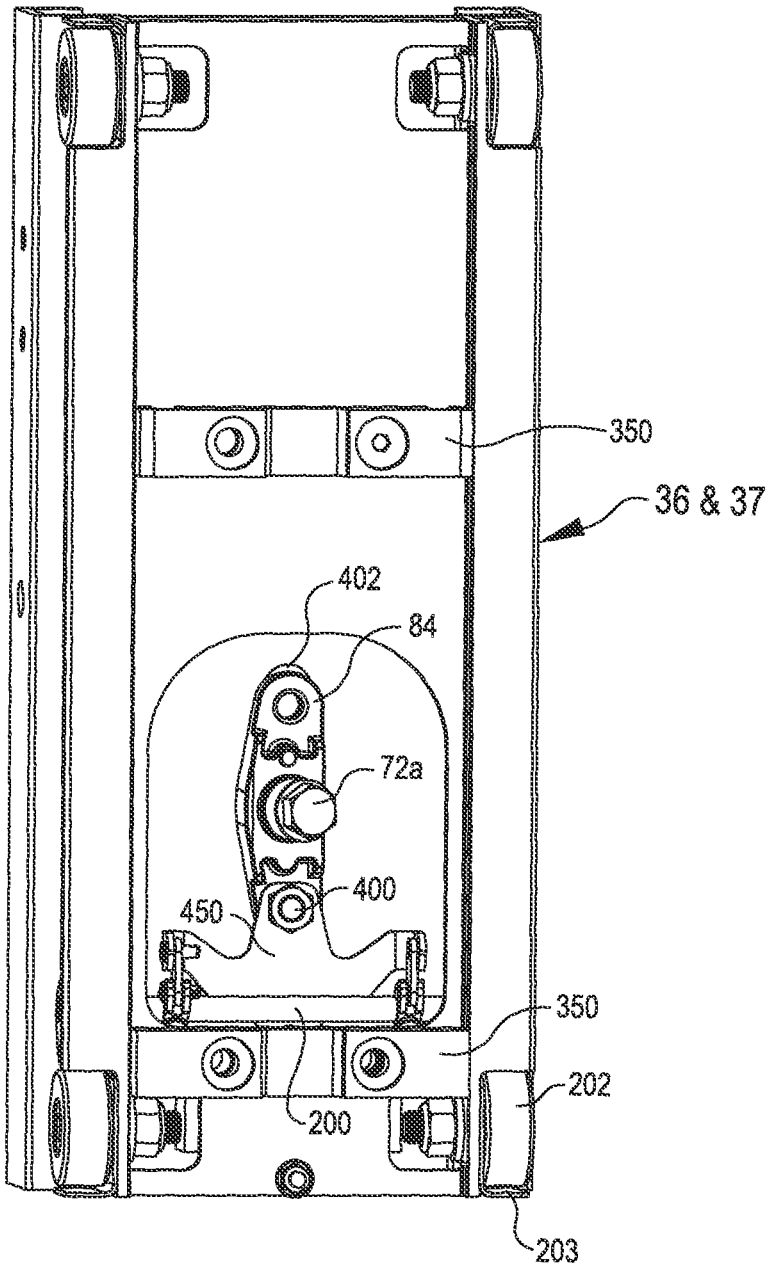
FIG. 11 depicts the bottommost portion of a multi-stage lift with the cable pulley and pulley guard removed from view allowing visibility of a pulley-mount block and a connection point to an actuating linkage.

The fasteners 400 (only one shown in FIG. 13) that mount the spring loaded lower pulley-mount 84 are connected through bushings 350 (FIG. 13) that are seated in slotted holes 402 (top one best shown in FIG. 13, and bottom one covered by flat washer 460 in FIG. 13) on the lift stage. The fasteners 400 are directly connected to the pulley mount 84, and the fasteners and the lower pulley mount 84 are fixed together to the linkage 450. The bushings 350 are formed of a material, such as bronze, that may easily slide in the slotted holes 402 without excessive wear. These bushings are taller than the adjacent metal on the mast stage section so that the fasteners 400 may be tightened with the washers 460 seating against the bushings, but not against the mast stage surface. Thus, even after tightened in place, the bushings 350, the flat washer 460, pulley mount 84 are still free to move up and down in the slotted holes 402, which permits vertical movement of the lower pulley-mount 84 and the pulley. Another fastener 72*a* (FIG. 14) connects the pulley 72 to the pulley mount 84, while sandwiching the pulley guard 90 in place. The pulley-mounts 84 are spring biased so they biased downward (FIGS. 11 and 12). When no cable tension is present at the lower cable pulley the pulley mounts 84 move downward, until positioned in a lowermost position. Otherwise, the pulley mounts 84 are pulled by the cable, against the tension of the spring bias, to an upper position. Thus, the lower pulleys 72 and pulley mounts 84 are positioned downward when the cable is not in tension, and upward when cable tension is present.

Figure 9:
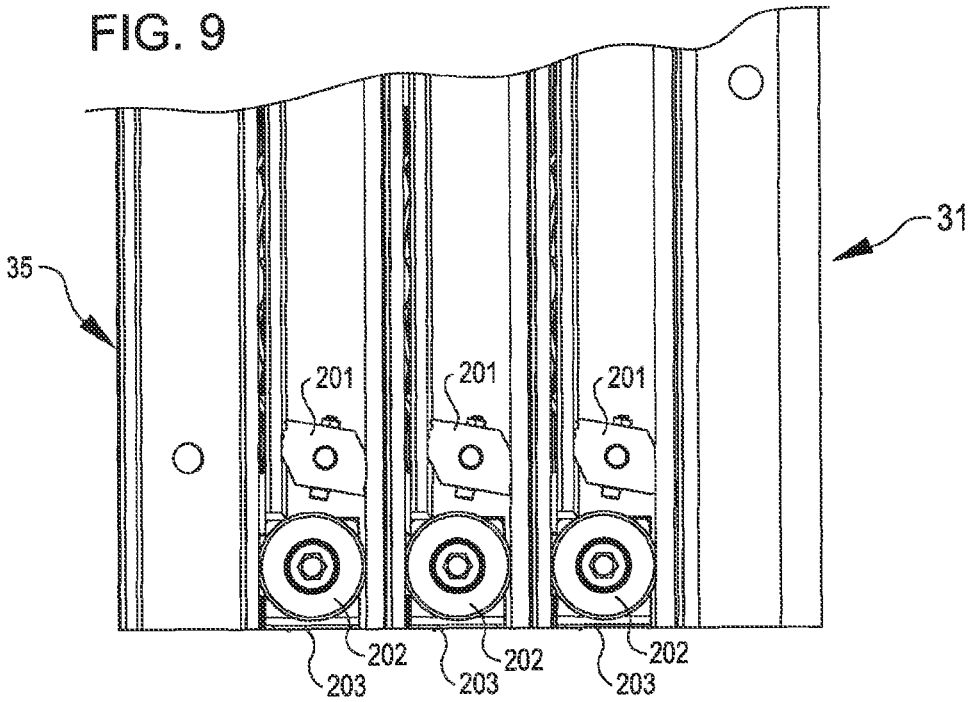
FIG. 9 is a partial cutaway, side view of the mast assembly depicting the knurled cams in an engaged position.
Figure 13:
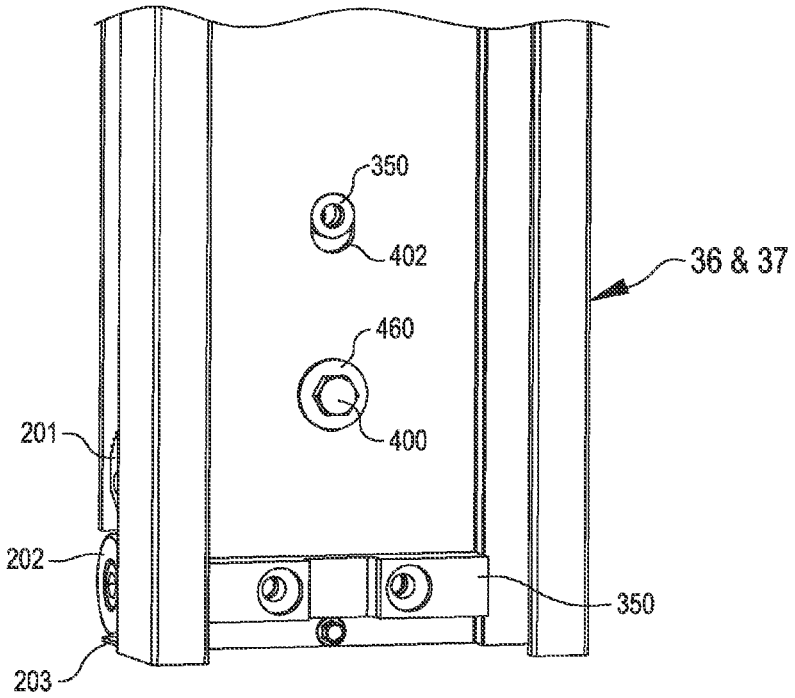
FIG. 13 depicts the view of the opposite side of the mast assembly shown in FIG. 12.

Each pulley mount 84 is connected to an upper mechanical linkage 450 (FIGS. 11 and 13). This linkage 450 is connected by small connecting rods to a lower linkage 200. The knurled cams 201 are fixed at ends of the lower linkage 200. The lower linkage 200 is fixed in position, and is loosely mounted for free rotation in the respective mast section. The small connecting rods are connected eccentrically to the lower linkage. Thus, when the upper linkage 450 moves upward and downward with the pulley mount 84, the small connecting rods push and pull on the eccentric mounting of the lower linkage 200, rotating the lower linkage and the knurled cams 201. When the upper linkage advances downward, due to tension not being present, the upper linkage and lower linkage rotate the knurled cams 201 to the braking position (FIG. 9). In this position, the cams 201, which are mounted adjacent the rollers 202 in the right and left outwardly facing back channels 52, 53, are positioned to engage the front inturned flanges 46*c*, 47*c* of the adjacent channels, preventing sliding of adjacent mast sections. Thus, once cable tension is removed, i.e. the cable 73 breaks, the spring loaded pulley-mounts 84 move the upper mechanical linkage 450 and lower linkage 200, rotating the knurled cams 201 into a wedging position between adjacent mast stages, stopping or severely braking downward movement of all mast stages.

When cable tension is present, the pulleys move to the upward deactivated position, rotating the knurled cam 201 to the non-braking position. In this position, the cam is no longer in contact with the adjacent mast section, and the two sections are free to slide relative to each other.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A lift, comprising:

a first mast stage and a second mast stage adjoining the first mast stage, the first mast stage being arranged to extend to move upwardly in a first direction relative to the second mast stage;

a cable for moving the first mast stage upward relative to the second mast stage;

a pulley interfaced with the cable;

a spring-loaded pulley mount mounted to a supporting mast stage, the supporting mast stage being one of the first mast stage and the second mast stage, the pulley being directly mounted to the spring-loaded pulley mount, the pulley moving from a first position relative to the supporting mast stage to a second position relative to the supporting mast stage when tension from the cable is removed; and a brake mechanically coupled with the spring-loaded pulley mount by a mechanical linkage such that movement of the spring-loaded pulley mount from the first position relative to the supporting mast stage to the second position relative to the supporting mast stage mechanically actuates the brake such that the brake restricts movement of the first mast stage relative to the second mast stage when the spring-loaded pulley mount is in the second position relative to the supporting mast stage, and the brake permits movement of the first mast stage relative to the second mast stage when the spring-loaded pulley mount is in the first position relative to the supporting mast stage, the brake including a first cam attached to the first mast stage or the second mast stage, the first cam being engaged with a first engagement surface of the other of the first mast stage or the second mast stage when the spring-loaded pulley mount is in the second position relative to the supporting mast stage so as to restrict relative movement between the first mast stage and the second mast stage, the first engagement surface being parallel to the first direction.

2. The lift of claim 1, wherein the first cam rotates to engage the first engagement surface when the spring-loaded pulley mount moves to the second position relative to the supporting stage from the first position relative to the supporting stage.

3. The lift of claim 2, wherein the cable is reeved through a plurality of pulleys mounted on opposite ends of the first mast stage and the second mast stage, and wherein the plurality of pulleys includes the pulley supported by the spring-loaded pulley mount.

4. The lift of claim 3, wherein the spring-loaded pulley mount is slidably mounted on the supporting mast stage, and spring bias of the spring-loaded pulley mount against the tension of the cable is such that, when tension is removed from the cable, the spring-loaded pulley mount slides relative to the supporting mast stage due to the spring bias, said sliding causing the spring-loaded pulley mount to move from the first position relative to the supporting mast stage to the second position relative to the supporting mast stage.

5. The lift of claim 4, wherein the mechanical linkage translates sliding movement of the spring-loaded pulley mount relative to the supporting mast stage into rotation movement of the brake.

6. The lift of claim 4, wherein the spring-loaded pulley mount is mounted to the supporting mast stage via a slotted hole through the supporting mast stage, the slotted hole being elongated to accommodate relative movement between said slidably mounted pulley and the supporting mast stage when the pulley moves between the first position relative to the supporting mast stage and the second position relative to the supporting mast stage.

7. The lift of claim 5, wherein the brake is mounted in a channel on a side of one of the first mast stage and the second mast stage.

8. The lift of claim 5, wherein the brake includes a second cam, the second cam being engaged with a second engagement surface of the other of the first mast stage or the second mast stage when the pulley is in the second position relative to the supporting mast stage so as to restrict relative movement between the first mast stage and the second mast stage, the second engagement surface being parallel to the first direction, the first engagement surface and the second engagement surface being disposed on opposing sides of the pulley.

9. The lift of claim 1, wherein the cable is reeved through a plurality of pulleys mounted on opposite ends of the first mast stage and the second mast stage, and wherein the plurality of pulleys includes the pulley supported by the spring-loaded pulley mount.

10. The lift of claim 9, wherein the spring-loaded pulley mount is slidably mounted on the supporting mast stage, and spring bias of the spring-loaded pulley mount against the tension of the cable is such that, when tension is removed from the cable, the spring-loaded pulley mount slides relative to the supporting mast stage due to the spring bias, said sliding causing the spring-loaded pulley mount to move from the first position relative to the supporting mast stage to the second position relative to the supporting mast stage.

11. The lift of claim 10, wherein the mechanical linkage translates sliding movement of the spring-loaded pulley mount relative to the supporting mast stage into rotation movement of the brake.

12. The lift of claim 11, wherein the brake is mounted in a channel on a side of one of the first mast stage and the second mast stage.

13. The lift of claim 1, wherein the brake is mounted in a channel on a side of one of the first mast stage and the second mast stage.

14. The lift of claim 1, wherein the first cam comprises a knurled surface for engaging the first engagement surface.

15. A lift, comprising:

a first mast stage and a second mast stage adjoining the first mast stage;

a pulley slidably mounted on a supporting mast stage, the supporting mast stage being one of the first mast stage or the second mast stage, the pulley being biased in a first direction relative to the supporting mast stage;

a cable reeved through the pulley, tensioning on the cable causing the pulley to move relative to the supporting mast stage away from the first direction and the first mast stage to extend to move upwardly relative to the second mast stage;

a mechanical linkage connected to the pulley and configured to translate sliding of the pulley relative to the supporting mast stage to a movement of the mechanical linkage;

a brake, mechanically connected to the mechanical linkage and mechanically actuated by the movement of the mechanical linkage such that the brake permits movement of the first mast stage relative to the second mast stage when the pulley is in a first position relative to the supporting mast stage, and the brake restricts movement of the first mast stage relative to the second mast stage when the pulley is in a second position relative to the supporting mast stage, the brake including a first cam attached to the first mast stage or the second mast stage, the first cam being engaged with a first engagement surface of the other of the first mast stage or the second mast stage when the pulley is in the second position relative to the supporting mast stage so as to restrict relative movement between the first mast stage and the second mast stage, the first engagement surface being parallel to the first direction.

16. The lift of claim 15, wherein the mechanical linkage mechanically translates sliding of the pulley relative to the supporting mast stage to rotation of the brake.

17. The lift of claim 16, wherein the brake includes a second cam, the second cam being engaged with a second engagement surface of the other of the first mast stage or the second mast stage when the pulley is in the second position relative to the supporting mast stage so as to restrict relative movement between the first mast stage and the second mast stage, the second engagement surface being parallel to the first direction, the first engagement surface and the second engagement surface-being disposed on opposing sides of the pulley.

18. The lift of claim 15, wherein the brake is mounted in a side channel of at least one of the first mast stage and the second mast stage.

19. The lift of claim 15, wherein the first cam comprises a knurled surface for engaging the first engagement surface.

20. The lift of claim 15, wherein the pulley is mounted to the supporting mast stage via a slotted hole through the supporting mast stage, the slotted hole being elongated to accommodate relative movement between the pulley and the supporting mast stage when the pulley moves between the first position relative to the supporting mast stage and the second position relative to the supporting mast.

* * * * *